US006264528B1

(12) United States Patent
Doan et al.

(10) Patent No.: US 6,264,528 B1
(45) Date of Patent: Jul. 24, 2001

(54) REMOTE-CONTROLLED TOY TRASH TRUCK

(75) Inventors: Steve D. Doan, Aurora; James R. Barker, Englewood, both of CO (US)

(73) Assignee: Steve Doan, Aurora, CO (US)

( * ) Notice: Subject to any disclaimer, the term of this patent is extended or adjusted under 35 U.S.C. 154(b) by 0 days.

(21) Appl. No.: 09/270,545

(22) Filed: Mar. 17, 1999

(Under 37 CFR 1.47)

Related U.S. Application Data

(60) Provisional application No. 60/078,299, filed on Mar. 17, 1998.

(51) Int. Cl.[7] ..... A63H 33/30; A63H 30/04; A63H 17/26

(52) U.S. Cl. ..... 446/424; 446/456; 446/466; 280/685

(58) Field of Search ..... 446/424, 427, 446/428, 429, 454, 456, 466, 433; 280/676, 677, 678, 685, 683

(56) References Cited

U.S. PATENT DOCUMENTS

| | | | | |
|---|---|---|---|---|
| 2,430,248 | * | 11/1947 | Powarzynski | 280/685 |
| 2,705,388 | * | 4/1955 | Gokey | 446/424 |
| 3,598,262 | | 8/1971 | Kraus . | |
| 3,602,162 | | 8/1971 | Williams . | |
| 3,638,962 | * | 2/1972 | Gardner | 280/685 |
| 3,653,455 | * | 4/1972 | Hetteen | 280/685 X |
| 3,746,361 | * | 7/1973 | McGee | 280/685 X |
| 3,831,789 | | 8/1974 | Brewer . | |
| 4,242,953 | | 1/1981 | St-Gelais . | |
| 4,278,390 | | 7/1981 | Ahearn . | |
| 4,471,566 | | 9/1984 | Ishimoto . | |
| 4,694,846 | | 9/1987 | Bouchard . | |
| 4,715,767 | | 12/1987 | Edelhoff et al. . | |
| 4,844,682 | | 7/1989 | Edelhoff . | |
| 4,904,144 | | 2/1990 | Phillips . | |
| 4,917,648 | | 4/1990 | Hartje . | |
| 5,007,786 | | 4/1991 | Bingman . | |
| 5,033,930 | | 7/1991 | Kraus . | |
| 5,064,332 | | 11/1991 | Edelhoff et al. . | |
| 5,203,669 | | 4/1993 | Klossek et al. . | |
| 5,238,359 | | 8/1993 | Chen . | |
| 5,344,272 | | 9/1994 | Nuyts . | |
| 5,429,543 | * | 7/1995 | Tilbor et al. | 446/456 |
| 5,435,768 | * | 7/1995 | Dunleavy | 443/427 |
| 5,474,486 | | 12/1995 | Chilton et al. . | |

* cited by examiner

*Primary Examiner*—D. Neal Muir
(74) *Attorney, Agent, or Firm*—Dorsey & Whitney LLP

(57) ABSTRACT

The instant invention is directed toward a toy trash truck. More specifically, it relates to a remote-controlled toy trash truck capable of forward motion and realistic operation. The toy vehicle includes a propulsion system, including a plurality of tires, operably affixed to a frame member. There is also a trash-holding bin mounted on the frame member, and a load-lifting arm operably connected to the frame member and capable of lifting items (e.g., actual or simulated trash) for placement into the trash-holding bin. A signal receiver that receives and interprets signals from a remote-control device may be mounted on the frame member.

43 Claims, 10 Drawing Sheets

REMOTE-CONTROLLED TOY TRASH TRUCK

CROSS-REFERENCE TO RELATED APPLICATION

This application is a nonprovisional application corresponding to U.S. provisional application Ser. No. 60/078,299, filed Mar. 17, 1998.

BACKGROUND OF THE INVENTION a. Field of the Invention

The instant invention is directed toward a toy trash truck. More specifically, it relates to a remote-controlled toy trash truck capable of forward motion and realistic operation.

b. Background Art

Toy vehicles are well known. Remotely controlled and radio-remotely controlled toy vehicles are popular in the toy market. Manufacturers of such toys frequently attempt to duplicate well known vehicles. In particular, manufacturers constantly seek innovative ways to simulate reality in toy vehicles to enhance the entertainment value these toys provide.

SUMMARY OF THE INVENTION

It is an object of the disclosed invention to provide an improved remote-controlled toy vehicle. The toy vehicle of the preferred embodiment described below is toy trash truck having a propulsion system, including a plurality of tires, operably affixed to a frame member. There is also a trash-holding bin mounted on the frame member, and a load-lifting arm operably connected to the frame member and capable of lifting items (e.g., actual or simulated trash) for placement into the trash-holding bin. A signal receiver that receives and interprets signals from a remote-control device may be mounted on the frame member.

In another form, the toy trash truck comprises a propulsion system operably affixed to a frame member comprising at least one main longitudinal beam. The propulsion system includes at least one main drive motor having an output shaft, a plurality of tires, and a driveline drivingly connecting the output shaft to at least one driven tire of the plurality of tires. A trash-holding bin, which is mounted on the at least one main longitudinal beam in the preferred embodiment, has a top with a rear edge. The trash-holding bin is capable of moving between a resting position and a dumping position. The trash-holding bin further comprises a purge door and an overhead door, both of which are capable of moving between an open position and a closed position. Further, the overhead door is slidably mounted to the top of the trash-holding bin, and the purge door is hingedly mounted along the rear edge of the top of the trash-holding bin. A pair of U-shaped main dumpster-lifting arms are operably connected to the frame member at a main lift arm pivot pin and are capable of lifting items for placement into the trash-holding bin. A wireless signal receiver that is supported by the frame member receives and interprets signals from a remote-control device, and a battery power supply, which may also be supported by the frame member, is coupled to the wireless signal receiver. A plurality of servo motors are appropriately placed on the toy trash truck to accomplish many functions, including moving the entire toy truck forward and backward, rotating the pair of U-shaped main dumpster-lifting arms about the main lift arm pivot pins, opening the overhead door, opening the purge door, and moving the trash-holding bin between its resting position and its dumping position. Finally, a suspension system supports the truck above the plurality of tires.

A more detailed explanation of the invention is provided in the following description and is illustrated in the accompanying drawings.

DESCRIPTION OF THE PREFERRED EMBODIMENT

Figure 1:
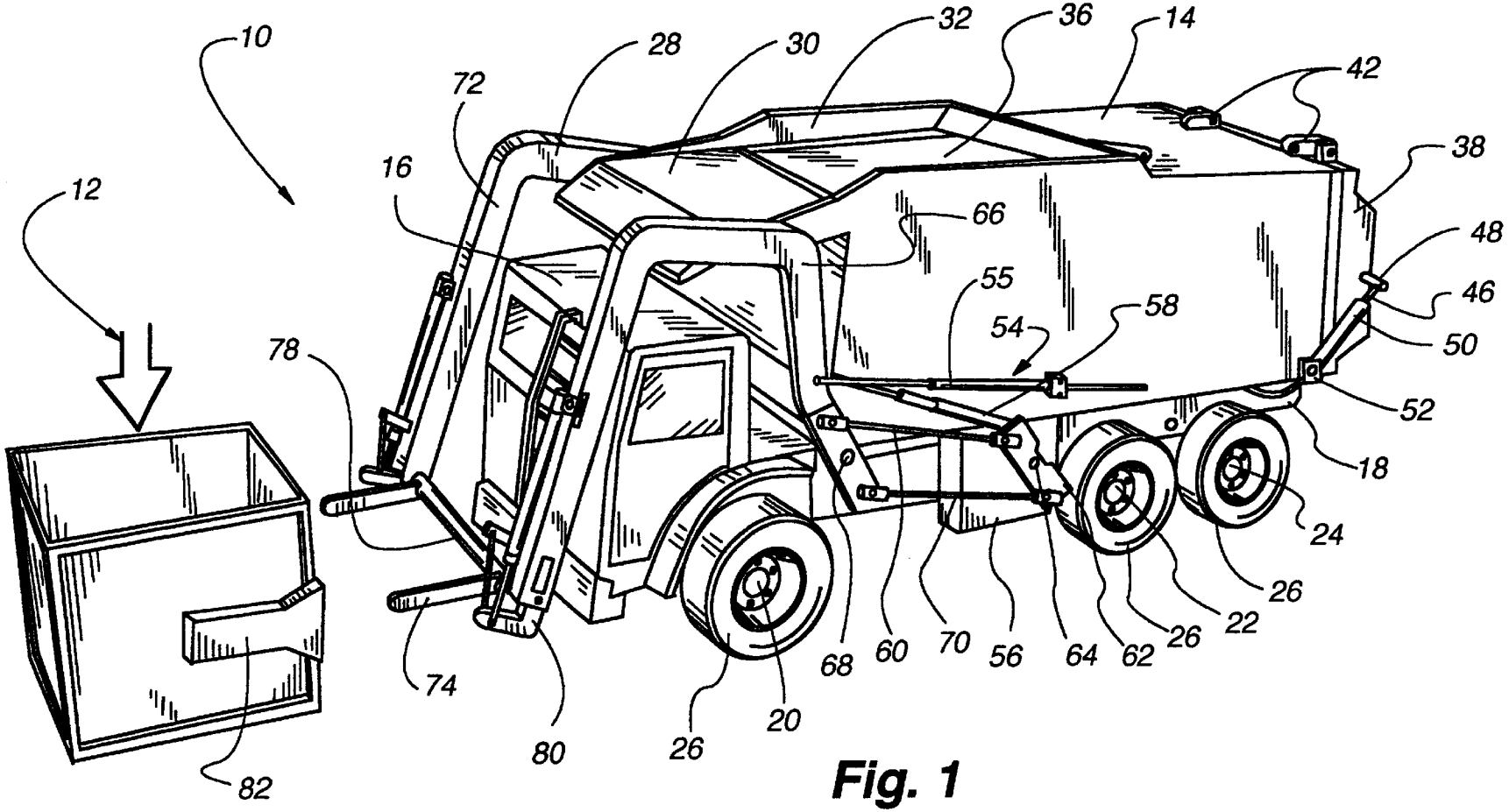
FIG. 1 is a perspective view of the toy trash truck of the present invention approaching a toy dumpster.

In the preferred embodiment of the remote-controlled toy trash truck 10 depicted in the accompanying drawings, the truck 10 operates in a realistic manner. The truck 10 is capable of moving forward and backward in a steerable fashion and is capable of actually dumping simulated trash from a toy dumpster 12 into a trash-holding box 14 of the toy trash truck 10. As best shown in FIG. 1, the toy trash truck 10 looks realistic. As will be further described below, the trash truck 10 requires a complex interaction between numerous actuators, servos, and motors to achieve its realistic impact.

Referring first to FIG. 1, the toy trash truck 10 includes an operator cabin or cab 16 attached to a pair of main longitudinal beams 18, one of which is visible in FIG. 1. A trash-holding box or "can" 14 is mounted on top of the main longitudinal beams 18 behind the operator cab 16. The operator cab 16 and can 14 are mounted on three axles, including a first or front axle 20, a second or middle axle 22, and a third or rear axle 24. Each axle has a pair of tires 26 rotatably mounted on it so that the trash truck 10 is mobile. Also associated with the trash truck 10 is a pair of U-shaped main dumpster-lifting arms 28 and a system of rods and actuators to control the motion of these arms 28. As depicted in FIG. 1, the trash truck 10 is used with a toy trash dumpster 12 in which simulated trash may be inserted.

Many details of the can 14 are also visible in the figures. Referring again to FIG. 1, the can 14 includes a cab-protection lip 30 that prevents objects in the trash dumpster 12 from accidentally impacting the top of the operator cab 16 as the dumpster 12 is raised over the trash truck 10 and dumped into the can 14. On the top of the can 14 is a trash guide rail 32 that surrounds three sides of an overhead trash hatch 34 (FIG. 12), which is generally covered by an overhead trash ingress door 36 whenever the operator is not attempting to dump trash into the can 14. A load purge door 38 is mounted on the back of the can 14. This load purge door 38 prevents trash dumped into the trash hatch 34 from immediately exiting the can 14 since the trash purge door 38 covers the entire rear opening 40 (FIG. 7) of the can 14. The trash purge door 38 is mounted to the top of the can using a pair of purge door hinges 42, but could be mounted, alternatively, to a side wall or the bottom of the can 14. Whenever a user desires to empty or purge the trash-holding can 14, they would signal the purge door opening system 44 (FIGS. 1, 9, 14, and 16), which will be described further below. Part of this purge door opening system 44 is visible in FIG. 1, namely a push cable 46, push cable mounting pin 48, push cable guide sleeve 50, and guide sleeve mounting bracket 52.

On one side wall of the can 14 is mounted a spring-loaded support arm 54, which helps the U-shaped main dumpster-lifting arms 28 raise the dumpster 12 to reduce the amount of force that must be generated by a servo motor 56 (FIG. 1) for the main dumpster-lifting arms 28. Although the preferred embodiment uses only one spring-loaded support arm 54 mounted to the left side of the truck 10, clearly this spring-loaded support arm 54 could be mounted to the opposite side of the truck. Alternatively, a spring-loaded support arm 54 could be attached to each side of the truck 10, or, if the servo motor 56 were large enough or if the can 14 were light enough, no spring-loaded support arm 54 may be required at all. In the figures (e.g., FIGS. 1–6), the spring-loaded support arm 54 is depicted as comprising a tubular member 55 housing a spring (not shown) that helps the U-shaped main dumpster-lifting arms 28 raise the dumpster. The inventors have, however, also used a standard coil spring (not shown) that is not contained or shielded in tubular member 55.

A second, lower arm 58 is also attached to the side of the can 14. In the preferred embodiment, a lower arm 58 is attached to each side of the can 14, and each lower arm 58 comprises three concentric brass sleeves that simulate the hydraulic arm or shock used on real trash trucks. Thus, in the preferred embodiment, this lower arm 58 primarily provides for a realistic appearance, but does little to assist any mechanical functions of the trash truck 10. If a more realistic appearance were desired, a spring could be incorporated within one or both of these lower arms 58 to help the U-shaped main dumpster-lifting arms 28 raise the dumpster 12. Then, the spring-loaded support arm 54 shown in FIG. 1 would be unnecessary.

The U-shaped main dumpster-lifting arms 28 have a number of actuators, servos, and lift-assist arms associated with them in addition to those alluded to above. The primary force for lifting the dumpster 12 over the trash truck 10 to dump the dumpster's contents through the trash hatch 34 and into the can 14 is provided by a pair of cooperating push-pull arms 60, 70. These cooperating arms 60, 70 are attached to a rectangular, pivoting driven block 62, which itself is mounted to an output shaft 64 rotated by a servo motor 56 for the main dumpster-lifting arms 28.

The upper arm 60 of the cooperating push-pull arms 60, 70 is attached to a rear leg 66 of the U-shaped main dumpster-lifting arm 28 just above a main lift arm pivot pin 68. The other end of this upper push-pull arm 60 is attached to an upper portion of the driven block 62. Similarly, the lower arm 70 of the cooperating push-pull arms 60, 70 is attached to the rear leg 66 of the dumpster-lifting arm 68 at a point below the main lift arm pivot pin 68. The distance between the main lift arm pivot pin 68 and the attachment point for the lower push-pull arm 70 is substantially the same as the distance between the main lift arm pivot pin 68 and the attachment point of the upper push-pull arm 60.

As with the upper push-pull arm 60, the rear or second end of the lower push-pull arm 70 is also attached to the driven block 62. Again, the distance between each respective push-pull arm 60, 70 and the output shaft 64 of the servo motor 56 is approximately the same. Thus, when the servo motor 56 for the main dumpster-lifting arm 28 operates to raise the U-shaped main dumpster-lifting arm 28, the servo motor 56 rotates the driven block 62 in a clockwise direction in FIG. 1. This would cause the upper push-pull arm 60 to pull on the rear leg 66, while the lower push-pull arm 70 would push on the rear leg 66. This cooperating push-pull action operates to rotate the U-shaped main dumpster-lifting arm 28 about the main lift arm pivot pin 68. As previously mentioned, the spring-loaded support arm 54, having a rear end mounted to the can 14 and a forward end mounted to the rear leg 66 of the U-shaped main dumpster-lifting arm 28, assists during this dumpster-lifting operation, thereby reducing the amount of force that must be generated by the servo motor 56 for the main dumpster-lifting arm 28.

The front legs 72 of the U-shaped main dumpster-lifting arms 28 have dumpster tilt forks 74 operably mounted to them. A tilt fork servo motor 76 (shown to best advantage in FIG. 9) is mounted on each front leg 72 to assist in tilting the trash dumpster 12. The dumpster tilt forks 74 move in unison by virtue of a tilt fork tie beam 78 traversing the gap between the front legs 72 near the free ends of the front legs 72. The details of the dumpster tilt fork system are more clearly visible in FIG. 9, which will be described below, but a tilt fork rotator arm 80 is visible on the left front leg 72 in FIG. 1.

The dumpster 12 depicted in FIG. 1 approximates dumpsters used by commercial establishments and private citizens. It provides a substantial receptacle for trash to be stored before the trash truck 10 arrives to haul it away. On each side of the trash dumpster 12 is a tilt fork socket 82, which guides the tilt forks 74 into mechanical engagement with the dumpster 12 and provides a surface against which the dumpster tilt forks 74 may press as the dumpster 12 is raised above the trash truck 10.

Figure 2:
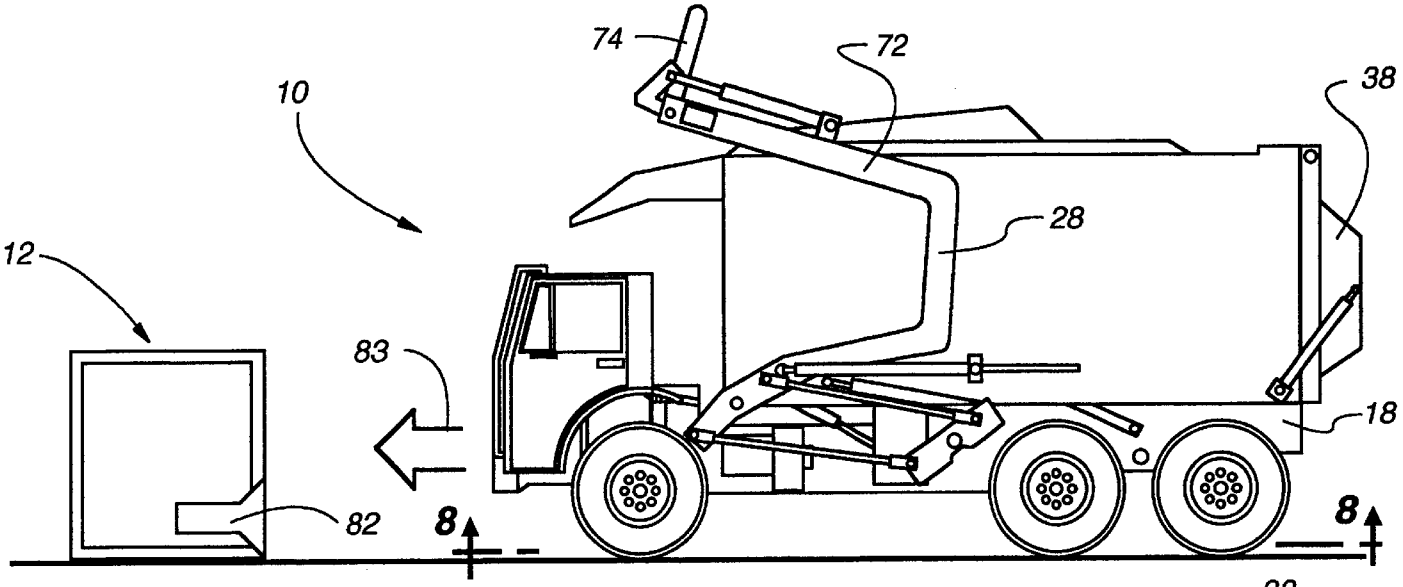
FIGS. 2–6 show various stages of a dump scenario, from approaching the toy dumpster through dumping the contents from that dumpster into the toy trash truck holding box.
Figure 3:
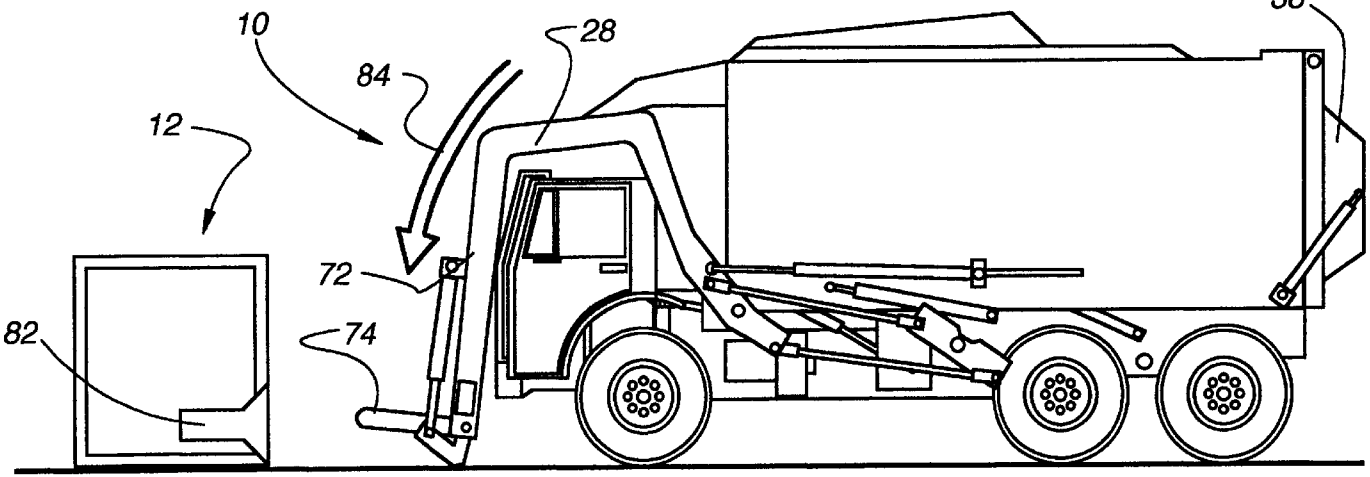
Figure 4:
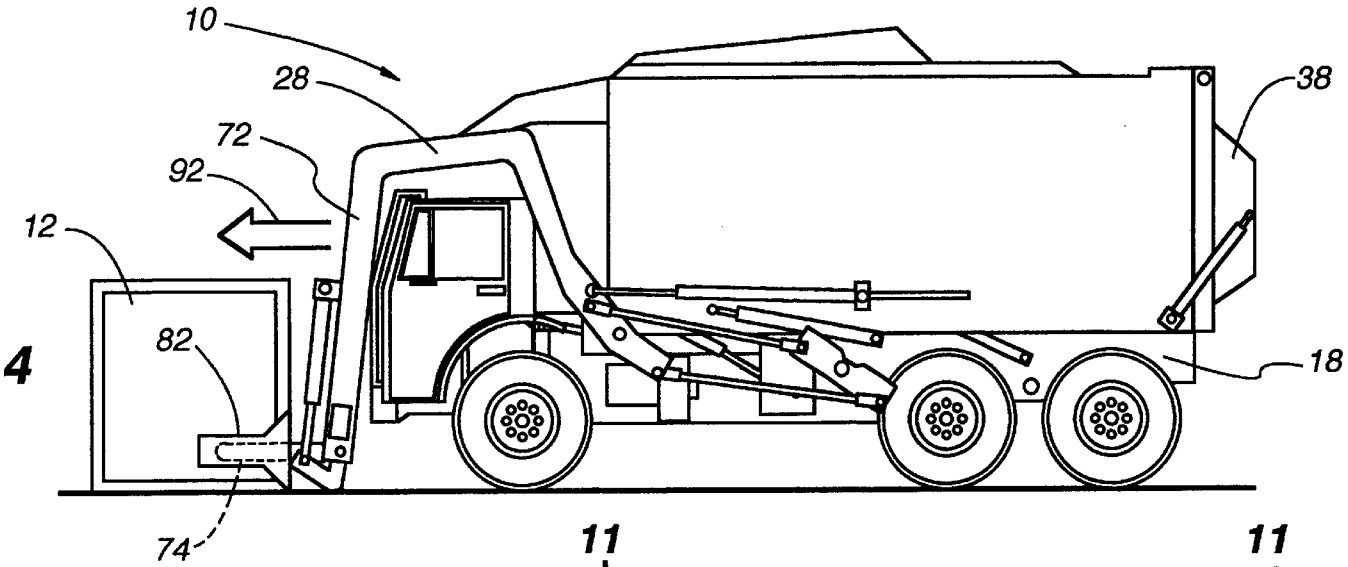
Figure 5:
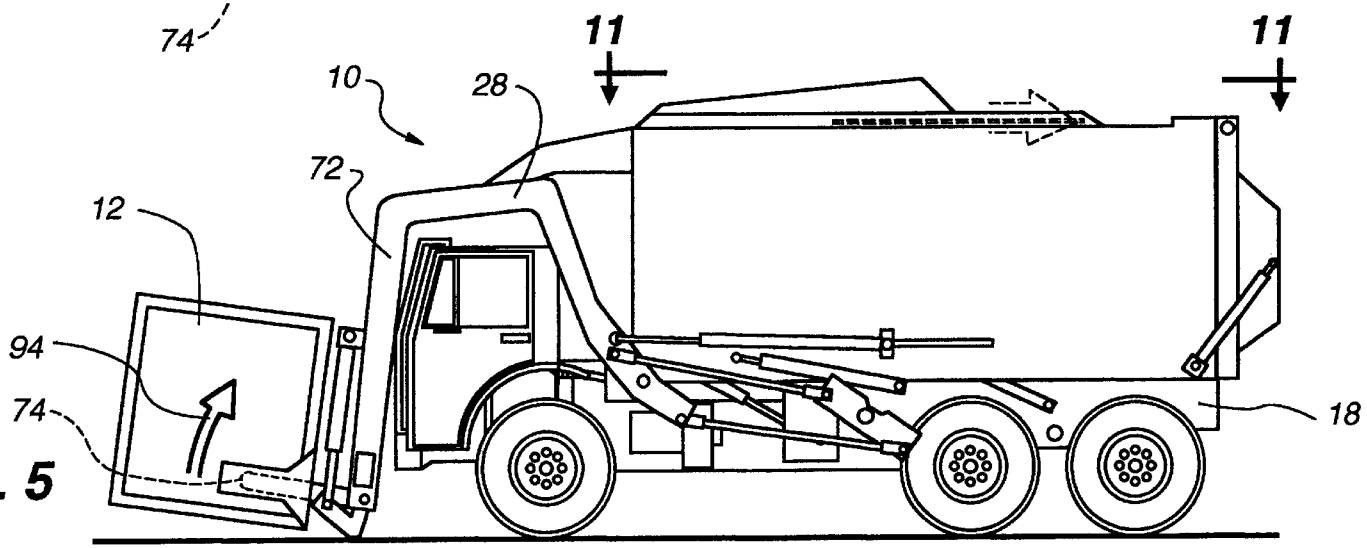
Figure 11:
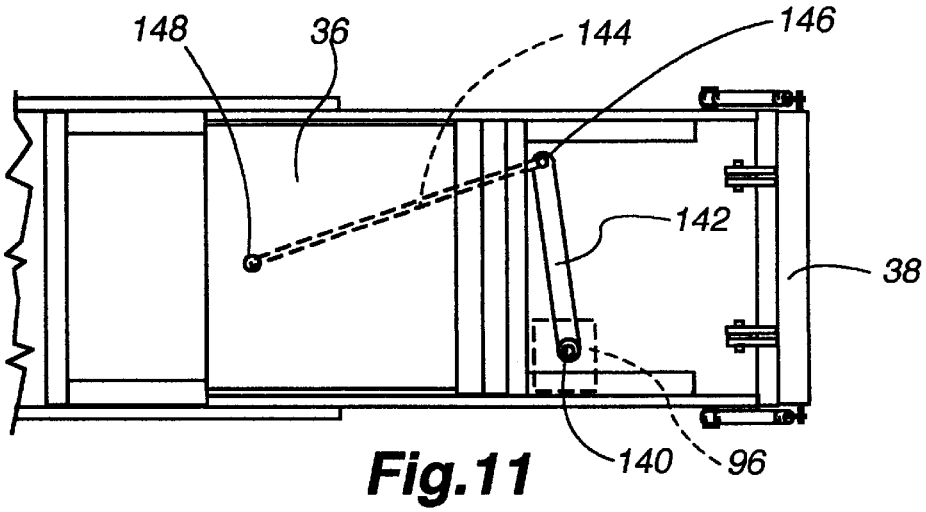
FIG. 11 is a partial top view along line 11—11 of FIG. 5, showing the overhead trash ingress door in a closed position.
Figure 12:
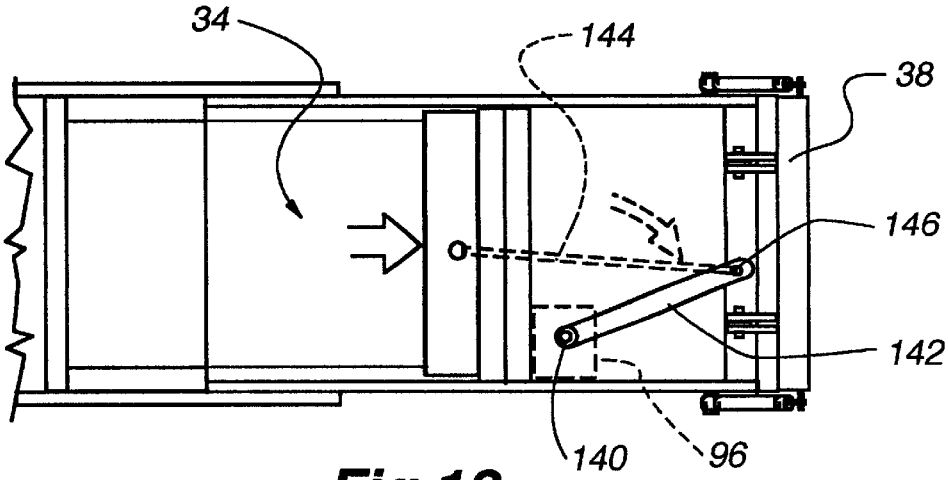
FIG. 12 is a partial top view of the trash truck wherein the overhead trash ingress door is open, exposing the trash hatch.

Referring now to FIGS. 2–6, some capabilities of the trash truck 10 are next described. In FIG. 2, the main dumpster-lifting arms 28 are in their raised position, above the trash truck 10 as it approaches a dumpster 12 to be emptied along path 83. As the trash truck 10 gets closer to the dumpster 12, the main dumpster-lifting arms 28 are lowered along a path 84 (FIG. 3) into their operating position. These main dumpster-lifting arms 28 may either be lowered as the truck 10 approaches the dumpster 12, or the truck 10 may be stopped shortly in front of the trash dumpster 12 and the arms 28 lowered at that point. As the truck 10 approaches the dumpster 12, the operator of the toy 10 would be controlling two drive motors 86, 88 depicted to best advantage in FIG. 8. These drive motors 86, 88 are responsible for propelling the vehicle 10 forward and backward. It may also be required while the trash truck 10 approaches the dumpster 12 for the toy operator to steer the truck 10 either left or right. If steering is required, a separate steering unit servo 90, also visible to good advantage in FIG. 8, may come into play. When the main dumpster-lifting arms 28 are lowered, this is accomplished by the servo motor 56 (FIG. 1) for the main dumpster-lifting arms 28. Finally, the preparation for picking up the trash dumpster 12 generally involves activation of the two tilt fork servo motors 76 (one for each tilt fork 74) mounted on the front legs 72 of the main dumpster-lifting arm 28 (a tilt fork servo motor 76 is visible to good advantage in FIG. 9). With the U-shaped main dumpster-lifting arms 28 lowered and the dumpster tilt forks 74 correctly angled (substantially parallel to the ground as depicted in FIG. 3), the trash truck 10 must move forward along a path 92 (FIG. 4) so that the dumpster tilt forks 74 engage the tilt fork sockets 82 of the trash dumpster 12. This step is seen to best advantage in FIG. 4. After the dumpster tilt forks 74 are engaged in the tilt fork sockets 82 of the trash dumpster 12 (FIG. 4), the tilt fork servo motors 76 are activated to rotate the dumpster tilt forks 74 thereby rocking the dumpster towards the front legs 72 of the U-shaped main dumpster-lifting arms 28 along path 94 (FIG. 5). At this point the overhead trash ingress door 36 (FIG. 1) is moved from a closed position (FIG. 11) to an open position (FIG. 12). A separate servo motor 96 is used to open the overhead trash ingress door 36 exposing the trash hatch 34. This latter servo motor 96 is seen to best advantage in FIG. 11. The opening of the overhead trash ingress door 36 may be accomplished before the dumpster 12 is lifted over the trash truck 10, or it may occur simultaneously with the lifting action.

Figure 6:
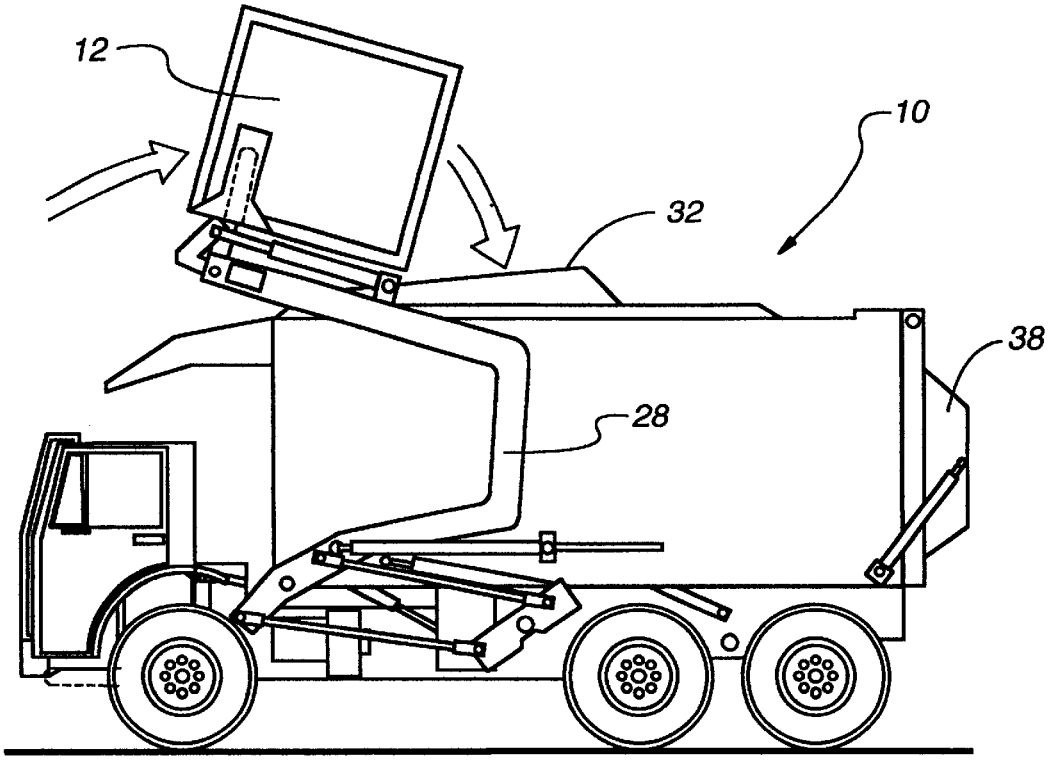

Referring now to FIG. 6, the main dumpster-lifting arms 28 are raised to their uppermost position, causing any simulated or actual rubbage in the mini trash dumpster 12 to fall through the trash hatch 34 (FIG. 12) and into the can 14. As the trash falls, it may contact the trash guide rails 32 surrounding the trash hatch 34. The stages involved in picking up the dumpster and dumping it overhead are then reversed, and the dumpster 12 is set back on the ground before the truck 10 pulls away from it.

Figure 7:
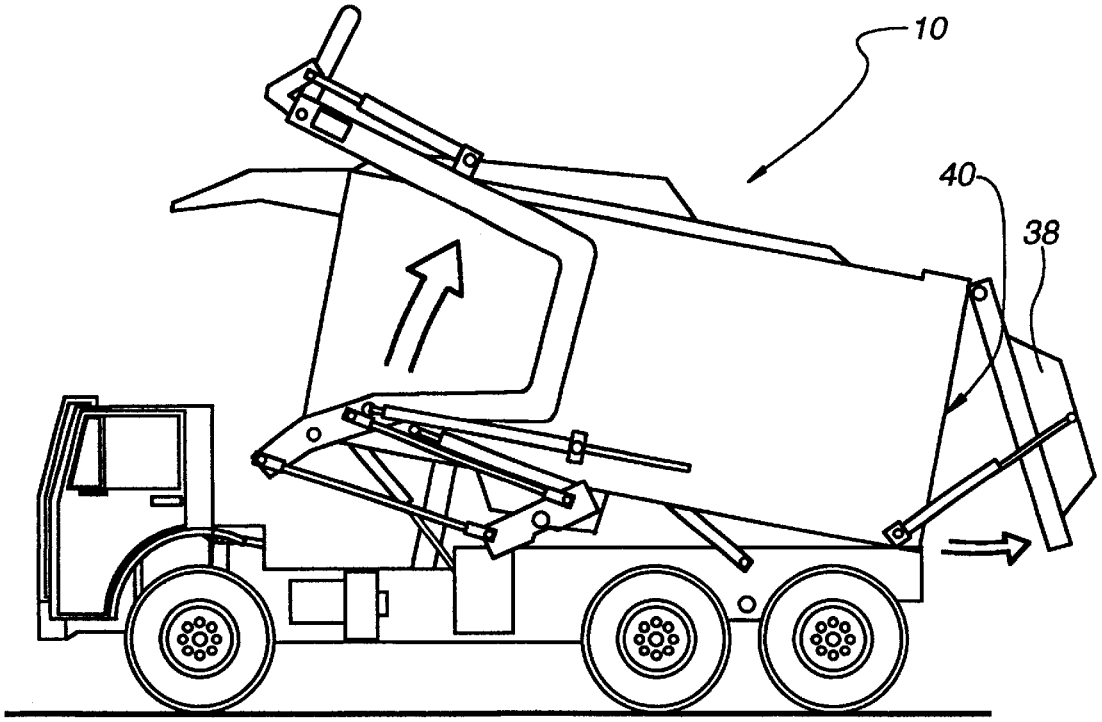
FIG. 7 is a side view showing the toy trash truck purging trash from the trash holding box.

Referring now to FIG. 7, purging of the trash in the trash-holding box or can 14 will be described. The trash purging operation involves at least two additional servo motors: a servo motor 98 (FIG. 14) to lift the can 14 from its center, and a servo motor 100 (FIG. 14) that opens the load purge door 38. The operation of these servos is described in further detail below. In FIG. 7, both servos 98, 100 have been activated, and the can 14 has been thereby pivoted upward, while the trash load purge door 38 has been forced to an open position.

Figure 8:
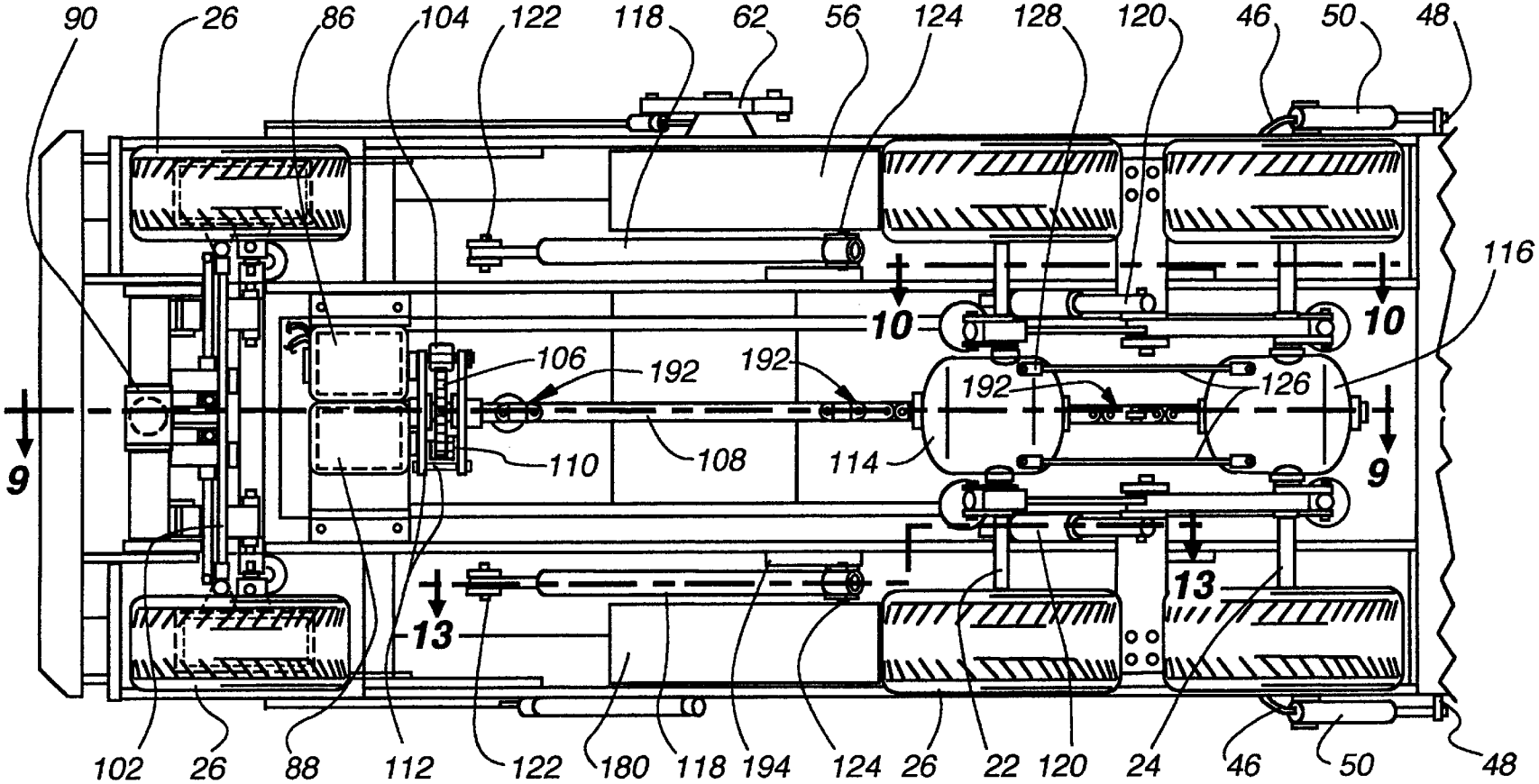
FIG. 8 is a bottom view of the toy trash truck taken along line 8—8 of FIG. 2, showing many of the drive line and suspension details.

FIG. 8 depicts various features visible on the underside of the trash truck 10. Since the trash truck 10 is steerable by a user operating a remote-controlled radio unit (not shown), several details of the steering unit are visible from the underside of the trash truck 10. Namely, a steering stabilizer tie rod 102 may be seen. This tie rod 102 ensures that when the steering unit servo 90 is activated, the front tires 26 move substantially in unison. Also visible in FIG. 8 are the first and second main drive motors 86, 88, respectively. The first drive motor 86 turns a first drive gear 104 engaged with a drive shaft gear 106, which itself turns a drive shaft 108. A second drive gear 110 is operated by the second main drive motor 88. This second drive gear 110 is also engaged with the drive shaft gear 106. Thereby, the first main drive motor 86 and the second main drive motor 88 cooperate to turn the drive shaft gear 106. Clearly, several motors could be used or a single larger motor could be used to spin the drive shaft 108, and the invention should not be limited by the use of two main drive motors 86, 88 in the preferred embodiment. The interaction between the first and second drive gears 104, 110 and the drive shaft gear 106 is stabilized by mounting the various gears in a gear-mounting frame 112. The drive shaft gear 106 turns the drive shaft 108, which, in turn, turns the gears in differentials 114, 116 operably associated with the second and third axles 22, 24, respectively. This drive system works in a manner similar to the manner in which most actual vehicles operate.

Also visible in FIG. 8 are the four lift-assist cylinders 118, 120, including two front lift-assist cylinders 118 and two rear lift-assist cylinders 120. Each front lift-assist cylinder 118 is mounted to the vehicle 10 using a pair of mounting pins: an upper mounting pin 122 and a lower mounting pin 124. These pins 122, 124 may be seen to good advantage in FIG. 8. These four lift-assist cylinders 118, 120 help the servo motor 98 (FIGS. 9 and 14) that lifts the can 14 from its center.

Figure 13:
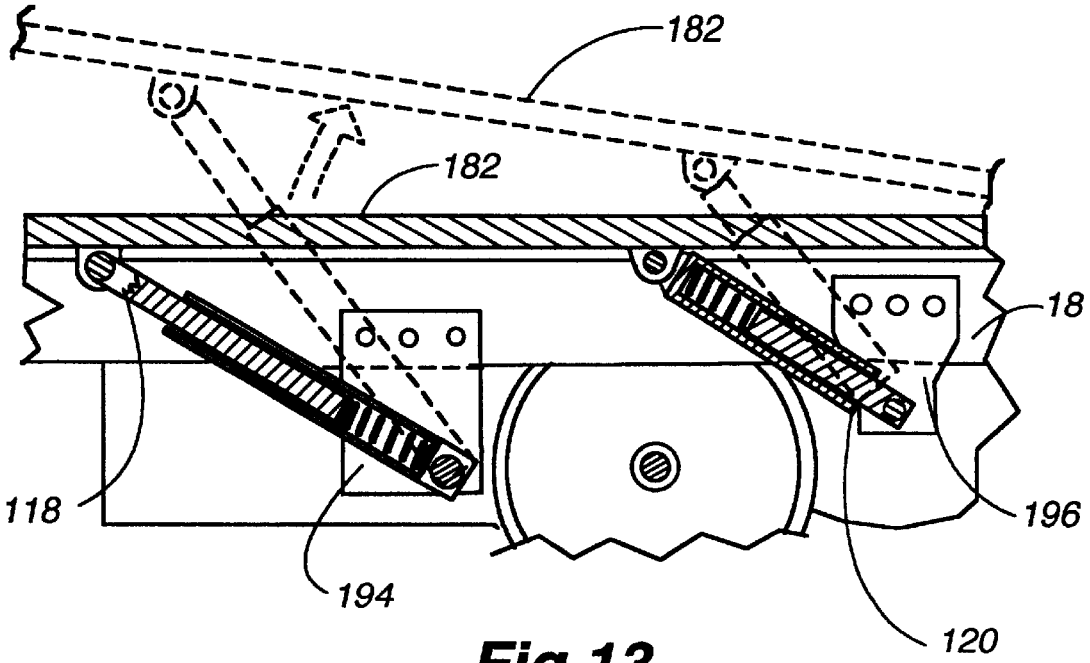
FIG. 13 is a partial cross-sectional view taken along line 13—13 of FIG. 8 and depicting further details of a front lift-assist cylinder and a rear lift-assist cylinder.

As depicted in FIG. 13, the front and rear lift-assist cylinders 118, 120 include concentric sleeves and coil springs. In the preferred embodiment, the sleeves are brass. The operation of the spring pressing on one end of the internal sleeve helps the main lift servo motor 98 perform its function. A pair of differential stabilizer bars 126 are also visible in FIG. 8. These stabilizer bars 126 have end caps 128 on them that are affixed to the bottom of each differential 114, 116 housing. These stabilizer bars 126 cooperate in their mission to prevent the differentials 114, 116 from changing position relative to each other due to the torque and rotational forces generated as the trash truck 10 is propelled forward and backward. The driven block 62 and the servo motor 56 for moving the main dumpster-lifting arms 28 are visible in the top portion of FIG. 8. At the rear of the truck 10, as depicted in FIG. 8, it is also possible to see the underside of the purge door cable guide sleeves 50 on each side of the truck 10.

Figure 9:
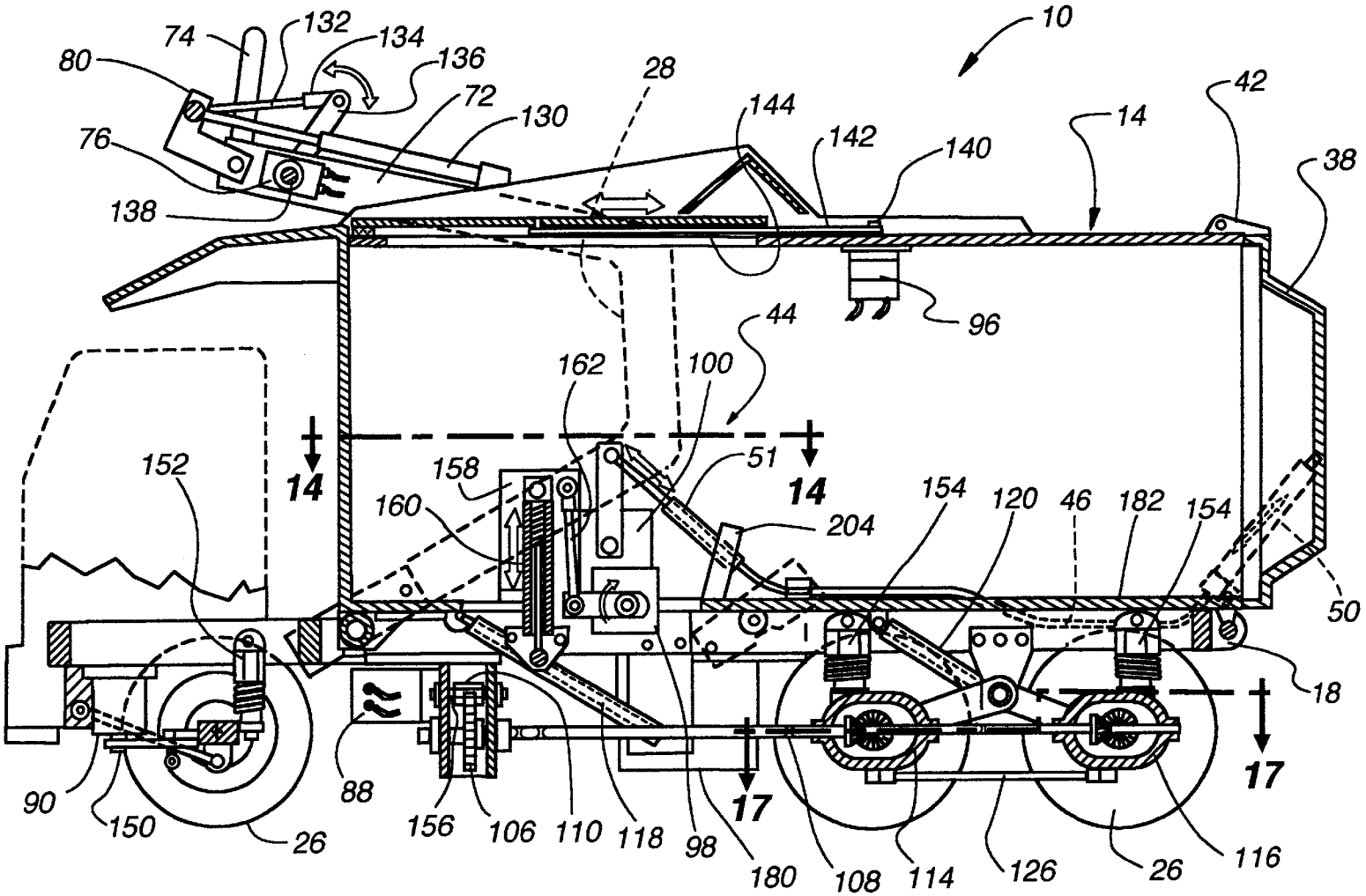
FIG. 9 is a cross-sectional view taken along line 9—9 of FIG. 8, depicting suspension and drive line details in addition to details about the systems that permit trash loading and dumping.

Referring now to FIG. 9, further details about some of the features described above will be discussed along with additional features not yet mentioned. FIG. 9 is a partial cross-section of the truck 10 substantially sliced through its middle along line 9—9 of FIG. 8. In the top left of FIG. 9, details about the dumpster tilt fork system are visible. This view shows the inside of the right hand dumpster tilt fork 74 and of the right hand front leg 72 of the right main dumpster-lifting arm 28. Clearly visible is a simulated hydraulic fork-actuator arm 130. Although a hydraulic device would activate the dumpster tilt fork in a real trash truck, this simulated hydraulic fork-actuator arm 130 is primarily for appearances in the toy trash truck 10 of the present invention. The dumpster tilt fork 74 is operably associated with the tilt fork rotator arm 80. This tilt-fork rotator arm 80 is itself rotatably pinned to a forced transfer arm 132 having an end cap 134 that is rotatably pinned to a tilt-fork actuator arm 136. The tilt-fork actuator arm 136 is, in turn, fixed to a servo motor output shaft 138. When the tilt-fork servo motor 76 rotates its output shaft 138, this, in turn, proportionately rotates the tilt-fork actuator arm 136. Movement of the tilt-fork actuator arm 136 is transferred to the tilt-fork rotator arm 80 via the force transfer arm 132 and its end cap 134. Finally, the tilt-fork rotator arm 80 actually pivots the dumpster tilt fork 34. As seen to best advantage in FIG. 5, this rotation of the dumpster tilt fork 74 rocks the dumpster 12 toward the front legs 72 of the main dumpster-lifting arms 28.

The servo motor 96 to open the overhead trash ingress door 36 can be seen clearly in FIG. 9. It is mounted to the underside of the top of the trash box or can 14. The output shaft 140 of this servo motor 96 protrudes through the top of the can 14 where it is connected to an overhead door actuator arm 142 (FIGS. 9, 11, and 12). The overhead door actuator arm 142 is connected to a door opening force transfer arm 144 through a ball joint connection 146 (FIG. 11). The remote or opposite end of the door opening force transfer arm 144 is connected to the underside of the overhead trash ingress door 36 by a second ball joint connection 148. This second ball joint connection 148 is attached to a mounting block fixed to the underside of the overhead trash ingress door 36.

Referring now to the lower portion of FIG. 9, the drive line of the trash truck 10 is clearly visible. The steering unit servo 90 and its output shaft 150 are clearly visible near the front portion of the front tire 26. A left front shock 152 is mounted to the left main longitudinal beam 18 and is operably connected to the front axle 20 (FIG. 1). These front shocks 152, one of which is clearly visible in FIG. 9, are off-the-shelf products in the preferred embodiment as are the four rear shocks 154, two of which are visible in FIG. 9. The second main drive motor 58, including its output shaft 156 and the second drive gear 110, is visible in FIG. 9. The second drive gear 110 is in meshing relation to the drive shaft gear 106, which rotates the drive shaft 108 of the trash truck 10. As may be seen in FIG. 9, in the preferred embodiment, an operating differential 114, 116 is associated with each rear axle (i.e., both the second axle 22 and the third axle 24), even though the details of only the front differential 114 is provided in FIG. 17 for simplicity. One of the front lift-assist cylinders 118 and one of the rear lift-assist cylinders 120 are also visible in FIG. 9.

Referring now to the central portion of FIG. 9, and FIG. 14 and FIG. 15, the main system for lifting the can 14 during the dumping operation will be described. The main can lifting system comprises a can lifting tower 158, a center lift-assist cylinder 160, a lift force transfer arm 162, a can-lift actuator arm 164, and the servo motor 98 for lifting the can 10, among other items. Referring specifically to FIG. 15, the servo motor 98 for lifting the can 14 has an output shaft 166 that is operably connected to a can-lift actuator arm 164. The can-lift actuator arm 164 is rotatably pinned at a first pivot connection 168 to the force transfer arm 162. The force transfer arm 162 is pivotally connected to the can lift tower 158 at a second pivot connection 170. The details of the second pivot connection 170 are more clearly visible in FIG. 14.

In operation, when the servo motor 98 is activated in a known manner by a remote-controlled radio unit, it rotates the can-lift actuator arm 164 with the servo output shaft 166. This, in turn, drives the force transfer arm 162 upward or downward. Assuming the force transfer arm 162 is being driven upward (i.e., the servo output shaft 166 is being rotated clockwise in FIG. 15), the force transfer arm 162 pushes upward on the can-lift tower 158. Since the can-lift tower 158 is attached to the bottom surface of the can via lift tower mounting screws 172, when the force transfer arm 162 presses upward on the can-lift tower 158, this urges the can 14 into a dumping configuration best shown in FIG. 7. The central lift-assist cylinder 160, comprising concentric brass sleeves or cylinders having a coil spring compressed thereby, constantly urges the trash can 14 in an upward direction. This central lift-assist cylinder 160 is mounted to the main longitudinal beams 18 via a lower mounting plate 174 and a lower mounting pin 176. The top end of the central lift-assist cylinder 160 is connected to the lift tower 168 via an upper mounting pin 178. Although the central lift-assist cylinder 160 cannot by itself lift the trash holding box 14, it urges the trash holding box 14 upward, thereby removing some of the weight that the servo motor 98 would otherwise be required to overcome. The assistance provided by the central lift-assist cylinder 160 thus prevents some wear on the servo motor 98 that lifts the trash box 14, while also reducing the drain on a battery pack 180 visible in FIG. 8. If the battery pack 180 were replaced by an alternative, larger power supply (e.g., a power cord connected the trash truck 10 to a large detached batter pack (not shown) or a wall outlet), it would be less important to reduce drain on the battery pack 180.

Referring now to FIGS. 11 and 12, further details about the operation of the overhead trash ingress door 36 are as follows. As the trash truck 10 approaches the dumpster 12 to be emptied (FIGS. 1–3) and engages and begins to lift the trash dumpster 12 (FIGS. 4 and 5), the overhead trash ingress door 36 remains in a closed position in the preferred embodiment. This position is depicted in FIG. 11, wherein the servo motor 96 to open and close the trash ingress door 36 has rotated its output shaft 40 counterclockwise in FIG. 11 thereby rotating the overhead door actuator arm 142 counterclockwise in FIG. 11. This rotation of the overhead trash actuator arm 142 pushes the door opening force transfer arm 144, via the ball joint connection 146, toward the front of the trash truck 10 (to the left in FIGS. 11 and 12). Since the door opening force transfer arm 144 is connected to the underside of the overhead trash door 36, via a second ball joint connection 148, when the door opening force transfer arm 144 is driven forward, the overhead trash door 36 is simultaneously driven forward, thereby closing it. As the trash dumpster 12 is raised in preparation for the trash dumping stage (FIG. 6), the overhead trash door 36 is opened exposing the trash hatch 34 (FIG. 12). The overhead trash door 36 is opened by activating the trash door servo motor 96 to rotate its output shaft 140 in a clockwise direction in FIGS. 11 and 12. This clockwise rotation of the output shaft 140 in turn rotates the overhead door actuator arm 142 in a clockwise fashion. Since the overhead door actuator arm 142 is, as previously discussed, pinned to the door opening force transfer arm 144, when the door actuator arm 142 is rotated clockwise, it pulls the force transfer arm 144 toward the rear of the truck 10 (to the right in FIGS. 11 and 12). The rearward movement of the force transfer arm 144 pulls the overhead trash door 36 open since the force transfer arm 144 is attached to the underside of the overhead trash door 36.

Figure 10:
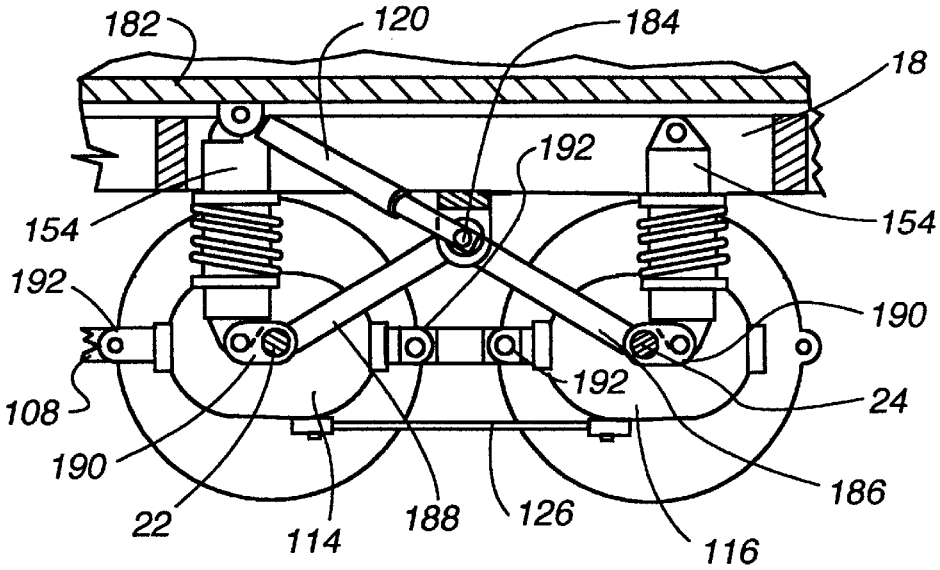
FIG. 10 is a partial cross-sectional view along line 10—10 of FIG. 8, depicting details of the rear suspension and a rear lift-assist cylinder.

Referring now to FIG. 10, some features of the rear suspension system are described next. Two of the four shocks 154 mounted on the rear axles 22, 24 of the trash truck 10 are visible in FIG. 10. As previously discussed, these shocks 154 are off-the-shelf shocks in the preferred embodiment. Also visible in FIG. 10 is the rear lift-assist cylinder 120, the upper end of which is fixed to a bottom plate or wall 182 of the trash holding box 14. The lower end of the rear lift-assist cylinder 120 is connected to a pin 184 that is itself mounted to one of the main longitudinal beams 18 of the vehicle 10. The pin 184 also acts as a pivot point for the scissor suspension system. The scissor suspension system comprises a rear leg 186 and a front leg 188. One end of the front leg 188 of the scissor suspension system is rotatably connected to the mounting pin 184 that is itself fixed to the main longitudinal beam 18. The second end of the front leg of the scissor suspension system is rotatably connected to the second axle 22. Similarly, the rear leg 186 of the scissor suspension system has its forward end connected to the mounting pin 184 that is rigidly attached to the main longitudinal beam 18, and its opposite end is rotatably connected to the third axle 24. The lower ends of the rear shocks 154 in the preferred embodiment are connected to a lower shock mounting bracket 190, which is operably fixed to the second 22 or third 24 axle, respectively. One of the differential housing stabilizer bars 126 is visible in FIG. 10 and ties the differential housings 114, 116 to one another to prevent their relative movement. A portion of the drive shaft 108 is shown extending into the front differential 114. A second portion of the drive shaft is visible between the two differentials 114, 116. Finally, in FIG. 10, the universal joints 192 that connect the various segments of the drive shaft to the differentials 114, 116 are visible. These universal joints 192 allow the differentials 114, 116 and the axles to move somewhat independently, but in a predefined manner with respect to each other.

Referring now to FIG. 13, the details of the front and rear lift-assist cylinders 118, 120, respectively, may be seen. In FIG. 13, the cross-sections of two of the lift-assist cylinders 118, 120 are depicted in solid lines while the trash holding box 14 is in its down or nondumping position. FIG. 13 also shows in phantom these two lift-assist cylinders 118, 120 while the trash holding box 14 is in a dumping position. Each lift-assist cylinder 118, 120 is attached via a mounting plate 194, 196 to a main longitudinal beam 18. The upper end of each lift-assist cylinder is pivotally attached to the underside of the bottom wall 182 of the trash holding box 14. Although the four lift-assist cylinders 118, 120 cannot by themselves lift the trash holding box 14, they assist the servo motor 98 that lifts the can 14 from its center during the lifting operation.

Figure 14:
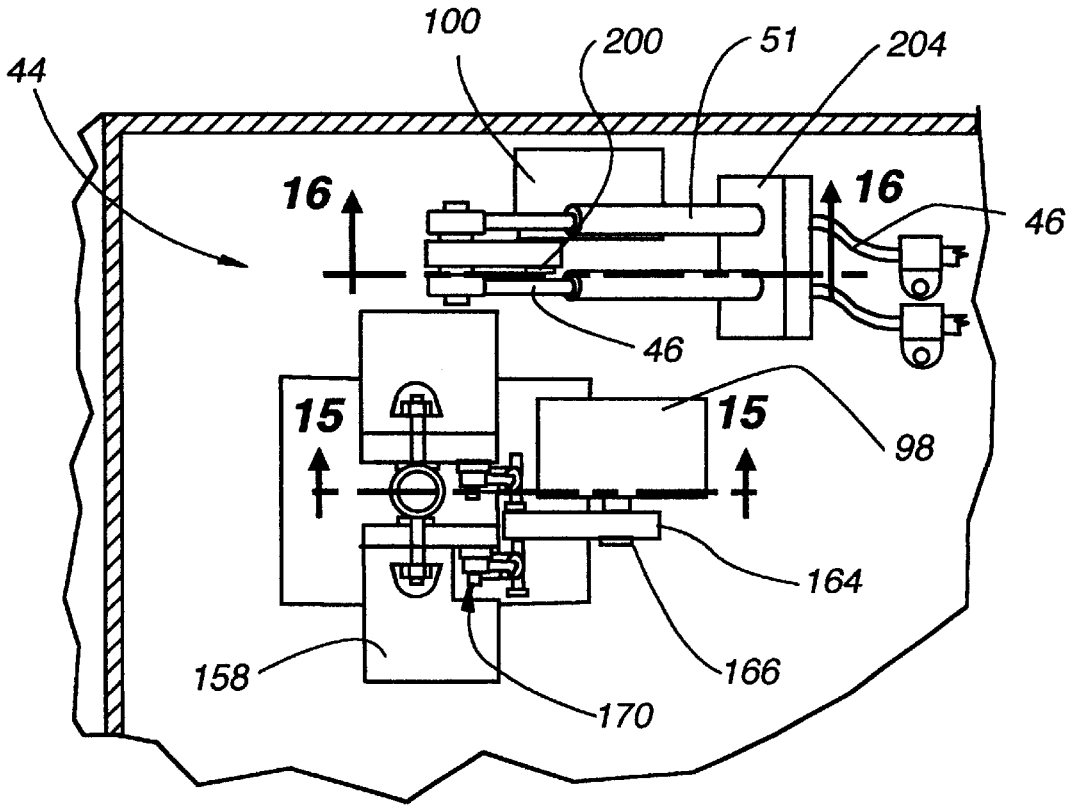
FIG. 14 is a partial cross-sectional view taken along line 14—14 of FIG. 9 and depicting details of the purge door opening system and the trash-holding box lifting system.
Figure 16:
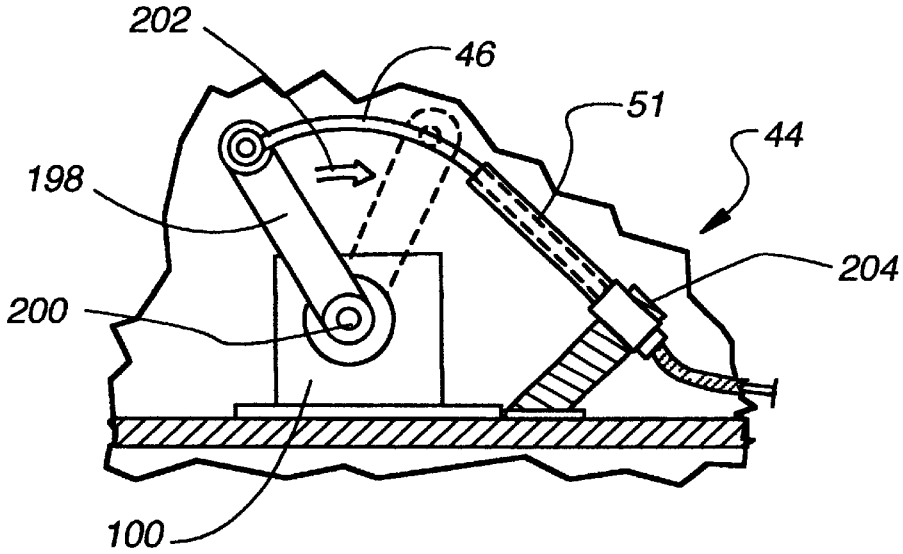
FIG. 16 is a partial cross-sectional view taken along line 16—16 of FIG. 14, showing details of a portion of the purge door opening system.
Figure 15:
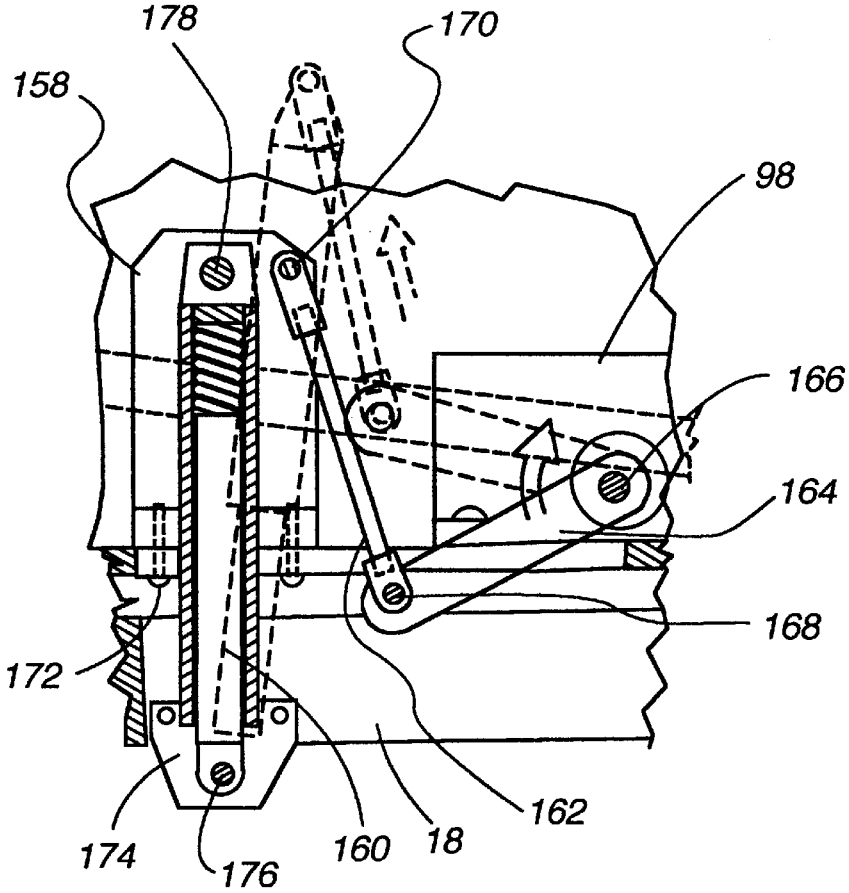
FIG. 15 is a partial cross-sectional view taken along line 15—15 of FIG. 14, showing further details of the trash-holding box lifting system.

Referring now to FIGS. 1, 7, 9, 14 and 16, details concerning the operation of the trash purge door 38 are next described. The top portion of FIG. 14 shows a top view of a portion of the system that operates the trash purge door 38 hingably mounted to the rear of the trash holding box 38. FIG. 9 shows the location of this system relative to the entire toy truck. The primary components of the system that operates the rear trash purge door 38 includes the servo motor 100, a purge door actuator arm 198, a flexible rod or cable 46 to transfer force, and various guide sleeves 50, 51 and mounting pins. Referring to FIG. 16, when the servo motor 100 that opens the load purge door 38 is commanded to open that door 38, the servo motor 100 rotates its output shaft 200 in a clockwise direction in FIG. 16. This clockwise rotation drives the purge door actuator arm 198, which is rigidly mounted to the servo motor output shaft 200, in a clockwise direction in FIG. 16. The clockwise rotation of the door actuator arm 198 pushes the flexible push cable 46 toward the rear of the truck 10, in a direction indicated by the large arrow 202 in FIG. 16. The motion of this push cable 46, as guided by various guide sleeves 50, 51, forces the rear purge door 38 to pivot open about its purge door hinges 42. In particular, the push cable 46 is pinned to a distal end of the purge door actuator arm 198 and then passes through a first guide sleeve 51 mounted to a guide sleeve support 204. It is clear from the top view (FIG. 14) that there are two such push cables 46 that simultaneously operate on both sides of the trash load purge door 38 (see also the right hand edge of FIG. 8 where both push cables 46 are visible).

Referring to FIG. 9, each push cable 46 is routed from the first guide sleeve 51, adjacent the servo motor 100, along the inside of the bottom floor 182 of the trash-holding box 14. At some point before the push cables 46 reach the rear end of the trash-holding box 14, they are routed through the bottom floor 182 of the trash-holding box 14. The flexible push cables 46 are subsequently routed through second push cable guide sleeves 50 (one is visible in FIG. 1; both are visible in FIG. 8). When the push cables 46 emerge from the rear end of the second push cable guide sleeves 50, they are connected to push cable mounting pins 48 (FIGS. 1 and 8) rigidly attached to the trash load purge door 38. Thus, operation of the purge door servo motor 100 rotates its output shaft 200, which is connected to the purge door actuator arm 198, ultimately resulting in movement of the trash load purge door 38 itself.

Figure 17:
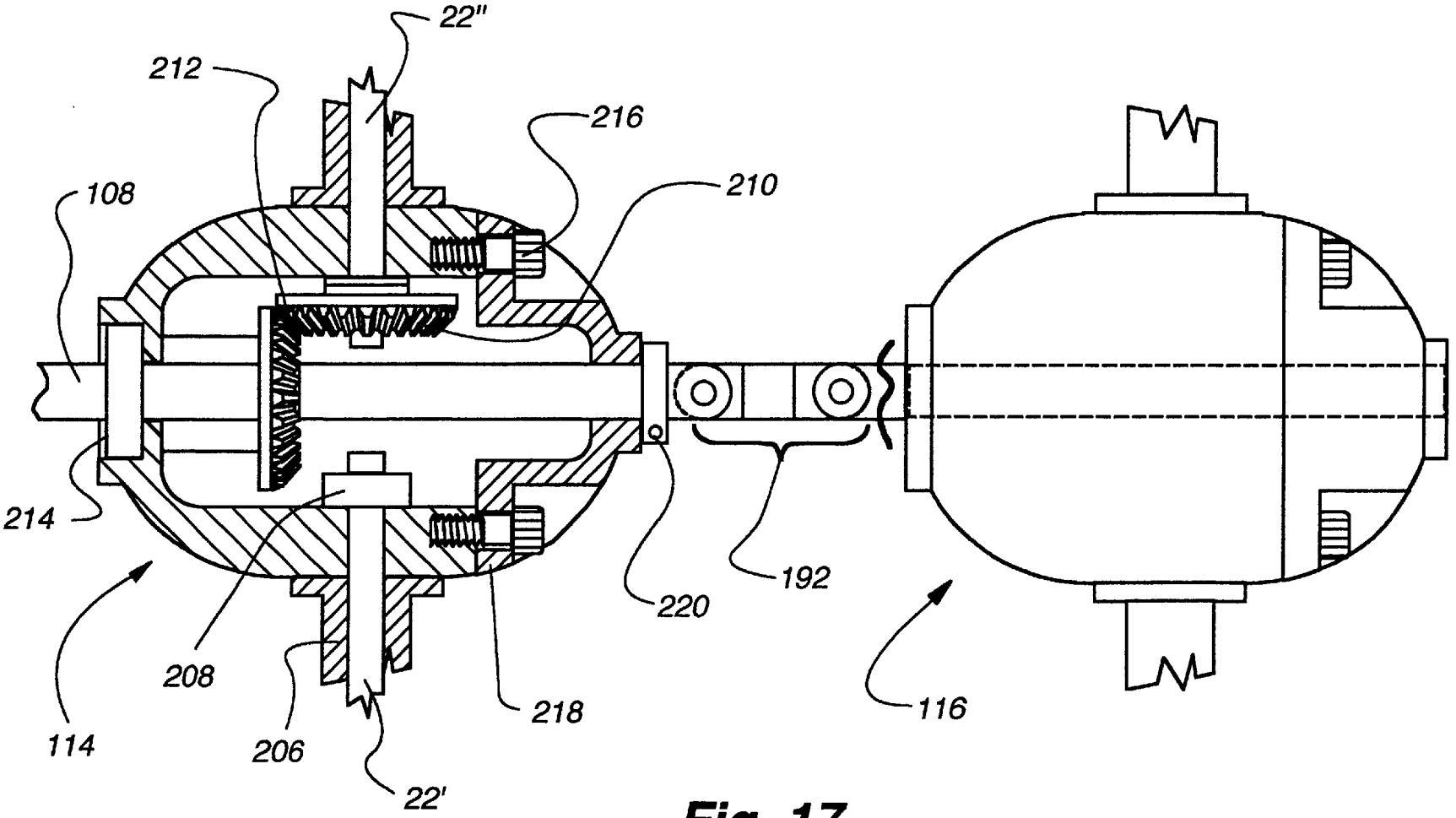
FIG. 17 is a partial cross-sectional top view taken along line 17—17 of FIG. 9 and depicting further details of the power transfer system and differentials.

FIG. 17 depicts the two rear differentials 114, 116, with the front differential 114 shown in partial cross-section. Looking first at the front differential 114, it may be seen that the second axle 22 in the preferred embodiment comprises two half axles 22', 22". In the preferred embodiment, the left side 22' of the second axle 22 is inserted within an axle housing 206 on the left side of the front differential 114. One end of this left side of the second axle is retained in the differential 114 by an axle retention collar 208. In the preferred embodiment, this left side 22' of the second axle 22 does not have a gear associated with it. This left side 22' of the second axle 22, therefore, merely freewheels and is not driven by the first or second main drive motors 86, 88, respectively. The right side or half 22" of the second axle 22, however, is driven by the main drive motors 86, 88. The differential end of this right side 22" of the second axle 22 has a driven taper gear 210 on it. This taper gear 210 is located inside of the front differential 114. A corresponding taper gear 212 is mounted around the drive shaft 108 section inserted through the front of the differential 114. The back side of this driving taper gear 212, which is attached to the drive shaft 108, impacts the differential housing 114 to prevent the drive shaft 108 from moving too far forward, to the left in FIG. 17. Similarly, a front retention collar 214, which rides inside an indentation in the differential housing 114, prevents the drive shaft 108 from moving too far rearward, to the right in FIG. 17. The drive shaft 108 is thereby maintained in a position that facilitates the interlocking of the teeth on the driving taper gear 212 with those on the driven taper gear 210 of the right side 22" of the second axle 22. Access to the interior of the front differential 114 is obtained by removing the differential assembly screws 216 that hold the differential backplate 218 on the front portion of the differential 114. Just outside the rear edge of the differential backplate 218 is a rear retention collar 220. This rear retention collar 220 is rigidly attached to the drive shaft 108 and prevents excessive movement of the drive shaft 108 in a forward direction. When the drive shaft 109 moves forward too much, the rear retention collar 220 impacts on the rear edge of the differential backplate 218. Between the front differential 114 and the rear differential 116 is a universal joint 192. This universal joint 192 permits some controlled relative movement between the front differential 114 and the rear differential 116. As previously discussed, however, the two stabilizer bars 126 connected to the underside of the differentials 114, 116 (not visible in FIG. 17) prevent excessive relative motion between the front and rear differentials 114, 116, respectively. The inside of the rear differential 116 is similar to that of the front differential 114, but has not been shown in FIG. 17 to simplify this drawing. In the preferred embodiment only one of the left and right sides of the third axle 24 is driven by the drive shaft 108. In the preferred embodiment, the right side of the third axle is driven, similar to what is shown in the interior of the front differential 114 in FIG. 17.

The toy trash truck described above sends, receives, and interprets remote-control signals in a known manner using off-the-shelf equipment. Although a preferred embodiment of this invention has been described above, those skilled in the art could make numerous alterations to the disclosed embodiment without departing from the spirit or scope of this invention. For example, the preferred embodiment disclosed above uses nine off-the-shelf servos to move various pieces and open various doors. The steering unit servo 90 in the preferred embodiment is Futaba 53303; the servo motor 56 that rotates the U-shaped main dumpster-lifting arms 28 is Victor 600 sail servo; the tilt fork servo motors 76 are Futaba S3101; the servo motor 96 used to open the overhead trash ingress door 36 is Futaba 53303; the servo motor 98 that lifts the can 14 is Futaba S3303; and the servo motor 100 that opens the load purge door 38 is Futaba S3303. The main drive motors 86, 88 in the preferred embodiment are standard motors commonly used in remote-control toy vehicles. One of ordinary skill in the art could, however, use different servos or eliminate some of these servos by combining or eliminating functions, or one of ordinary skill in the art could add additional servos to further enhance the operation of the toy truck described above. Additionally, one of ordinary skill could use a drive system based upon, for example, belts and pulleys rather than interlocking gears. An important feature of this invention is in its realism. In particular, the trash truck described above operates much like a real trash truck operates, but replaces hydraulic systems with servos, motors, and spring-driven systems. Also, in the preferred embodiment, many of the parts are made from either plastic or brass since these materials are relatively easy to work with. One of ordinary skill in the art could, however, select a variety of materials from which to build a toy truck within the scope of the present invention. All directional references (e.g., upper, lower, upward, downward, left, right, leftward, rightward, top, bottom, above, below, vertical, horizontal, clockwise, and counterclockwise) above are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative only and not limiting.

We claim:

1. A toy trash truck comprising a propulsion system operably affixed to a frame member, said propulsion system including a plurality of tires;

a trash-holding bin mounted on said frame member, said trash-holding bin comprising a bottom wall, a top wall, an overhead door selectively covering a trash hatch through said top wall, and a purge door, both of said doors being capable of moving between an open position and a closed position, and further wherein said overhead door is slidably mounted to a top of said trash-holding bin;

a load-lifting arm operably connected to said frame member and capable of lifting items for placement into said trash-holding bin;

an elevation system for lifting said trash-holding bin into a raised, dumping configuration and lowering said trash-holding bin into a lowered, loading configuration, said elevation system comprising a can-lift actuator arm;

a can lifting tower affixed to said bottom wall;

a lift force transfer arm rotatably connected at a first pivot connection to said can-lift actuator arm, and said lift force transfer arm rotatably connected at a second pivot connection to said can lifting tower; and a central lift-assist cylinder.

2. The truck of claim 1 further comprising a signal receiver that receives and interprets signals from a remote-control device.

3. The truck of claim 1, wherein said propulsion system further comprises at least one main drive motor and a driveline operably connecting said at least one main drive motor to at least one driven tire of said plurality of tires.

4. The truck of claim 3, wherein said at least one main drive motor further comprises an output shaft and said driveline further comprises a series of gears drivingly connecting said output shaft of said at least one main drive motor to a drive shaft, and further wherein said drive shaft is drivingly connected to at least one differential for transferring propulsive energy from said drive shaft to said at least one driven tire.

5. The truck of claim 4, wherein said drive shaft further comprises at least one universal joint.

6. The truck of claim 4, wherein said drive shaft further comprises a driving taper gear and wherein said at least one differential further comprises at least one driven taper gear engaged with said at least one driving taper gear.

7. The truck of claim 6 wherein said at least one driven taper gear is mounted on an axle drivingly connected to said at least one driven tire.

8. The truck of claim 7 further comprising a scissor suspension system supportingly connecting said axle to said frame member.

9. The truck of claim 6, wherein said series of gears comprises a first drive gear mounted for rotation with said output shaft of said at least one main drive motor, and a drive shaft gear mounted for rotation with said drive shaft.

10. The truck of claim 9, wherein said series of gears are rotatably supported in a gear-mounting frame.

11. The truck of claim 2, wherein said frame member comprises at least one main longitudinal beam, wherein said load-lifting arm comprises at least one U-shaped main dumpster-lifting arm having a rear leg and a front leg, and wherein said rear leg is pivotally attached to said at least one main longitudinal beam at a main lift arm pivot pin, and wherein said front leg is capable of supporting a load of said items to be placed in said trash-holding bin when said overhead door is in its open position.

12. The truck of claim 11, wherein a dumpster tilt fork is pivotally mounted on said front leg to pivotally support said load, and wherein a tilt fork pivot system is operatively associated with said dumpster tilt fork, said tilt fork pivot system comprising a tilt fork actuator arm;

a tilt-fork rotator arm rigidly connected to said dumpster tilt fork; and a force transfer arm rotatably pinned between said tilt for actuator arm and said tilt fork rotator arm.

13. The truck of claim 11 further comprising cooperating push-pull arms, said cooperating push-pull arms including an upper arm and a lower arm, each of said upper and lower arms having a first end and a second end, wherein said first end of said upper arm is pivotally connected to said rear leg of said at least one U-shaped main dumpster-lifting arm at a first location above said main lift arm pivot pin and said second end of said upper arm is pivotally connected to an upper portion of a driven block pivotally mounted to said at least one main longitudinal beam, and wherein said first end of said lower arm is connected to said rear leg of said at least one U-shaped main dumpster-lifting arm at a second location below said main lift arm pivot pin and said second end of said lower arm is connected to a lower portion of said driven block.

14. The truck of claim 13 further comprising a tilt fork servo motor for rotating a dumpster tilt fork pivotally mounted on said front leg of said at least one U-shaped main dumpster-lifting arm;

a first servo motor for rotating said at least one U-shaped main dumpster-lifting arm about said main lift arm pivot pin;

a second servo motor for opening said overhead door;

a third servo motor for opening said purge door; and a fourth servo motor for lifting said trash-holding bin.

15. The truck of claim 14, wherein said signal receiver is a wireless receiver, and wherein said truck further comprises a steering unit servo and wherein said truck is steerable through the remote activation of said steering unit servo.

16. The truck of claim 15, wherein said first servo is responsive to a first remote-control signal, said second servo is responsive to a second remote-control signal, said third servo is responsive to a third remote-control signal, said fourth servo is responsive to a fourth remote-control signal, said tilt fork servo is responsive to a fifth remote-control signal, and said steering unit servo is responsive to a sixth remote-control signal.

17. The truck of claim 16, wherein said third remote-control signal is the same as said fourth remote-control signal.

18. The truck of claim 1, wherein said frame member comprises at least one main longitudinal beam, wherein said central lift-assist cylinder has a bottom end and a top end, and wherein said central lift-assist cylinder further comprises concentric sleeves having a coil spring compressed thereby, said bottom end of said central lift-assist cylinder being mounted to said at least on main longitudinal beam, and said top end of said central lift-assist cylinder being connected to said lift tower.

19. The truck of claim 1 further comprising a purge door opening system, said purge door opening system comprising a purge door actuator arm;

a push cable mounting pin rigidly attached to said purge door; and a push cable mounted between said purge door actuator arm and said push cable mounting pin.

20. The truck of claim 19, wherein said purge door is hingedly mounted along an edge of said top wall of said trash-holding bin for rotation about at least one purge door hinge, wherein said purge door actuator arm is pivotally mounted to said bottom wall of said trash-holding bin, wherein said push cable has a first end and a second end, and wherein said purge door opening system further comprising a first push cable guide sleeve to slippingly support said push cable adjacent to said purge door actuator arm;

a guide sleeve support for positioning said first push cable guide sleeve adjacent to said purge door actuator arm;

a second push cable guide sleeve to slippingly support said push cable adjacent to said purge door; and a guide sleeve mounting bracket for positioning said second push cable guide sleeve adjacent to said purge door.

21. The truck of claim 20, wherein said bottom wall of said trash-holding bin has a cable hole therethrough, and further wherein said push cable passes through said cable hole along the length of said push cable between its said first end and second end.

22. The truck of claim 1 further comprising an overhead door opening system, said overhead door opening system comprising an overhead door actuator arm; and a door opening force transfer arm having first and second ends, said first end of said door opening force transfer arm being pivotally connected to said overhead door actuator arm, and said second end of said door opening force transfer arm being pivotally connected to an underside of said overhead door.

23. The truck of claim 22, wherein said first and second ends of said door opening force transfer arm are pivotally connected by ball joint connections to, respectively, said overhead door actuator arm and said underside of said overhead door.

24. The truck of claim 1, wherein said frame member comprises at least one main longitudinal beam, and wherein said elevation system further comprises at least one front lift-assist cylinder having an upper end and a lower end, said upper end of said at least one front lift-assist cylinder being mounted to a lower surface of said bottom wall of said trash-holding bin using a first upper mounting pin, and said lower end of said at least one front lift-assist cylinder being mounted to said at least one main longitudinal beam using a first lower mounting pin; and at least one rear lift-assist cylinder having an upper end and a lower end, said upper end of said at least one rear lift-assist cylinder being mounted to said lower surface of said bottom wall of said trash-holding bin using a second upper mounting pin, and said lower end of said at least one rear lift-assist cylinder being mounted to said at least one main longitudinal beam using a second lower mounting pin.

25. The truck of claim 24, wherein said lower ends of said front and rear lift-assist cylinders are mounted to said at least one main longitudinal beam using respective first and second mounting plates attached to said at least one main longitudinal beam.

26. The truck of claim 24, wherein said at least one front lift-assist cylinder comprises two front lift-assist cylinders, and wherein said at least one rear lift-assist cylinder comprises two rear lift-assist cylinders, and further wherein each said front and rear lift-assist cylinders comprises an internal sleeve slippingly engaged in a concentric external sleeve, and a coil spring, said coil spring mounted within said external sleeve and pressing on one end of said internal sleeve.

27. The truck of claim 1, wherein said elevation system further comprises at least one spring-loaded support arm having a rearward end mounted to said trash-holding bin and a forward end mounted to said rear leg of said at least one U-shaped main dumpster-lifting arm, said at least one support arm comprising a tubular member housing a spring.

28. The truck of claim 13, wherein a first distance between said first location and said main lift arm pivot pin is the same as a second distance between said second location and said main lift arm pivot pin.

29. The truck of claim 14, wherein said tilt fork servo motor further comprises an output shaft that is operably connected to said tilt fork actuator arm, whereby activation of said tilt fork servo motor rotates said tilt fork actuator arm, thereby driving said force transfer arm, said tilt fork rotator arm; and said dumpster tilt fork.

30. The truck of claim 14, wherein said first servo motor further comprises an output shaft that is operably connected to said driven block, whereby activation of said first servo motor rotates said driven block, thereby driving said push-pull arms and rotating said at least one U-shaped main dumpster-lifting arm about said main lift arm pivot pin.

31. The truck of claim 14, wherein said second servo motor further comprises an output shaft that is operably connected to said overhead door actuator arm, whereby activation of said second servo motor rotates said overhead door actuator arm, thereby driving said door opening force transfer arm and said overhead door.

32. The truck of claim 31, wherein said second servo motor is mounted to an underside of said top wall of said trash-holding bin, and wherein said output shaft of said second servo motor protrudes through said top wall of said trash-holding bin and is connected to said overhead door actuator arm.

33. The truck of claim 14, wherein said third servo motor further comprises an output shaft that is operably connected to said purge door actuator arm, whereby activation of said third servo motor rotates said purge door actuator arm, thereby driving said push cable and pivoting said purge door about said at least one purge door hinge.

34. The truck of claim 14, wherein said fourth servo motor further comprises an output shaft that is operably connected to said can-lift actuator arm, whereby activation of said fourth servo motor rotates said can-lift actuator arm, thereby driving said force transfer arm and said can-lifting tower.

35. A toy trash truck comprising a propulsion system operably affixed to a frame member comprising at least one main longitudinal beam, said propulsion system including at least one main drive motor having an output shaft, a plurality of tires, and a driveline drivingly connecting said output shaft to at least one driven tire of said plurality of tires;

a trash-holding bin having a top wall with a rear edge, said trash-holding bin mounted on said at least one main longitudinal beam, wherein said trash-holding bin is capable of moving between a lowered, resting position and a raised, dumping position, said trash-holding bin further comprising a purge door and an overhead door, both of said doors being capable of moving between an open position and a closed position, and further wherein said overhead door is slidably mounted to said top wall of said trash-holding bin and wherein said purge door is hingedly mounted along said rear edge of said top wall;

a pair of U-shaped main dumpster-lifting arms operably connected to said frame member at a main lift arm pivot pin and capable of lifting items for placement into said trash-holding bin;

a wireless signal receiver that receives and interprets signals from a remote-control device, said wireless signal receiver being supported by said frame member;

a battery power supply coupled with said wireless signal receiver and supported by said frame member;

a plurality of servo motors for rotating said pair of U-shaped main dumpster-lifting arms about said main lift arm pivot pin, opening said overhead door, opening said purge door, and moving said trash-holding bin between said resting position and said dumping position;

a suspension system supportingly connecting said plurality of tires to said frame member; and an elevation system for lifting said trash-holding bin into said raised, dumping position and lowering said trash-holding bin into said lowered, resting position, said elevation system comprising a can-lift actuator arm;

a can lifting tower affixed to said bottom wall;

a lift force transfer arm rotatably connected at a first pivot connection to said can-lift actuator arm, and rotatably connected at a second pivot connection to said can lifting tower; and a central lift-assist cylinder.

36. The truck of claim 35, wherein each of said U-shaped main dumpster-lifting arms further comprises a rear leg and a front leg, and wherein said rear leg is pivotally attached to said at least one main longitudinal beam at a main lift arm pivot pin, and wherein a dumpster tilt fork is pivotally mounted on a distal end of said front leg to pivotally support a load of said items to be placed in said trash-holding bin.

37. The truck of claim 36 further comprising cooperating push-pull arms, said cooperating push-pull arms including an upper arm and a lower arm, each of said upper and lower arms having a first end and a second end, wherein said first end of said upper arm is pivotally connected to said rear leg of at least one of said pair of U-shaped main dumpster-lifting arms at a first location above said main lift arm pivot pin and said second end of said upper arm is pivotally connected to an upper portion of a driven block pivotally mounted to said frame member, and wherein said first end of said lower arm is connected to said rear leg of said at least one of said pair of U-shaped main dumpster-lifting arms at a second location below said main lift arm pivot pin and said second end of said lower arm is connected to a lower portion of said driven block.

38. The truck of claim 37 wherein said plurality of servo motors comprises a first servo motor for rotating said pair of U-shaped main dumpster-lifting arms about said main lift arm pivot pin;

a second servo motor for opening said overhead door;

a third servo motor for opening said purge door;

a fourth servo motor for moving said trash-holding bin between said resting position and said dumping position; and a tilt fork servo motor for rotating said tilt fork.

39. The truck of claim 38, wherein said truck further comprises a steering unit servo, said truck being steerable through the remote activation of said steering unit servo, and wherein said first servo is responsive to a first remote-control signal, said second servo is responsive to a second remote-control signal, said third servo is responsive to a third remote-control signal, said fourth servo is responsive to a fourth remote-control signal, said tilt fork servo is responsive to a fifth remote-control signal, and said steering unit servo is responsive to a sixth remote-control signal.

40. The truck of claim 39, wherein said third remote-control signal is the same as said fourth remote-control signal.

41. The truck of claim 35, wherein said driveline further comprises a series of gears, a drive shaft, at least one universal joint, and at least one differential for transferring propulsive energy from said drive shaft to said at least one driven tire, and further wherein said series of gears includes a first drive gear mounted for rotation with said output shaft of said at least one main drive motor and engaged with a drive shaft gear mounted for rotation with said drive shaft, and wherein said drive shaft further comprises a driving taper gear and wherein said at least one differential further comprises at least one driven taper gear engaged with said at least one driving taper gear.

42. The truck of claim 41 wherein said at least one driven taper gear is mounted on an axle drivingly connected to said at least one driven tire.

43. The truck of claim 42, wherein said suspension system is a scissor suspension system.

* * * * *